United States Patent [19]

Morita et al.

[11] 4,412,506

[45] Nov. 1, 1983

[54] ADHESIVE COATING MACHINE

[75] Inventors: Shigeru Morita, Suita; Masami Furuhashi, Tokyo, both of Japan

[73] Assignee: Nippon Flute Co., Ltd., Tokyo, Japan

[21] Appl. No.: 419,064

[22] Filed: Sep. 16, 1982

[30] Foreign Application Priority Data

May 31, 1982 [JP] Japan ..... 57-92495

[51] Int. Cl.[3] ..... B05C 5/02

[52] U.S. Cl. ..... 118/683; 118/411

[58] Field of Search ..... 118/672, 674, 668, 679, 118/683, 410, 411, 315, 25

[56] References Cited

U.S. PATENT DOCUMENTS 2,877,763 3/1959 Paulsen ..... 118/410 X 3,327,680 6/1967 Talbot ..... 118/411 X

*Primary Examiner*—John P. McIntosh

*Attorney, Agent, or Firm*—James E. Nilles

[57] ABSTRACT

An adhesive coating machine in which a gear pump for pressure-feeding an adhesive is mechanically driven upon passage of an object matter to be coated with adhesive and ejects the adhesive on the object, and in which after the passage of the object the gear pump is reversely rotate so that the adhesive is prevented from flowing out. A drive wheel is positioned inside the passage of the object and rotated by the object matter to be coated during the passage thereof, thereby driving the gear pump.

3 Claims, 7 Drawing Figures

ADHESIVE COATING MACHINE

BACKGROUND OF THE INVENTION

1. Field of the Invention

This invention relates to an adhesive coating machine.

2. Description of the Prior Art

In producing corrugated cardboard boxes, for example, an adhesive such as a hot melt type is applied to the margins for the adhesive of the corrugated cardboard sheet. The conventional adhesive coating machine that has been most widely used has a construction in which the adhesive is pressure-fed into a nozzle by an air pump driven by an air pressure or a gear pump driven by a motor and an object matter to be coated that passes through the nozzle portion is detected by means of a detector such as a photoelectric tube, a limit switch or the like so that an air valve which is interposed between the pump and the nozzle and is driven by the air pressure or an electromagnetic valve is subjected to the ON-OFF control. The adhesive is ejected from the nozzle when the object matter to be coated which is fed into the nozzle portion is detected.

Accordingly, the adhesive coating machine of the kind above-described requires the power for the pump, the detector for the object matter to be coated, the switch valves for the discharge control of the adhesive and a control circuit for these devices and hence, becomes extremely costly.

SUMMARY OF THE INVENTION

With the background described above, the present invention is directed to provide an economical adhesive coating machine.

The adhesive coating machine in accordance with the present invention comprises a nozzle disposed so as to face the passage of an object matter to be coated; a gear pump for pressure-feeding an adhesive into the nozzle; a drive wheel disposed with the circumferential surface thereof positioned inside the passage and rotated by the object matter to be coated during the passage of the object matter, thereby driving the gear pump; a ratchet wheel disposed concentrically and integrally with the drive wheel; a swing arm fitted loosely and concentrically with the ratchet wheel and with the drive wheel and urged in the direction opposite the driving rotating direction of the drive wheel; a first stopper disposed so as to face the swing arm and anchoring the swing arm while the tip of the swing arm projects into the passage of the object matter; a ratchet pawl turnably supported by the swing arm and urged in such a direction that the tip of the pawl engages with the ratchet wheel; and a second stopper disposed so as to oppose the ratchet pawl in the arrangement such that it comes into contact with the ratchet pawl and disengages the tip of the ratchet pawl from the ratchet wheel when the tip of the swing arm is pushed by the object matter and rotates in the same direction as the driving rotating direction of the drive wheel and the tip moves back from the passage of the object matter during the passage of the latter; the gear pump being driven by the passage of the object matter via the drive wheel; the ratchet wheel being rotated by the return operation of the swing arm after the passage of the object matter, thereby rotating the drive wheel in a direction opposite the driving rotating direction of the drive wheel and reversely rotating the gear pump.

In accordance with the above-mentioned construction, the present invention eliminates the necessity of the power for the gear pump, the detector for detecting the object matter to be coated, the switch valves for the discharge control of the adhesive and the control circuit for controlling these devices, and prevents the adhesive from flowing out from the nozzle after the object matter to be coated has passed.

The other objects and features of the present invention will become more apparent from the following description to be taken in conjunction with the accompanying drawings.

DESCRIPTION OF THE PREFERRED EMBODIMENTS

Figure 1:
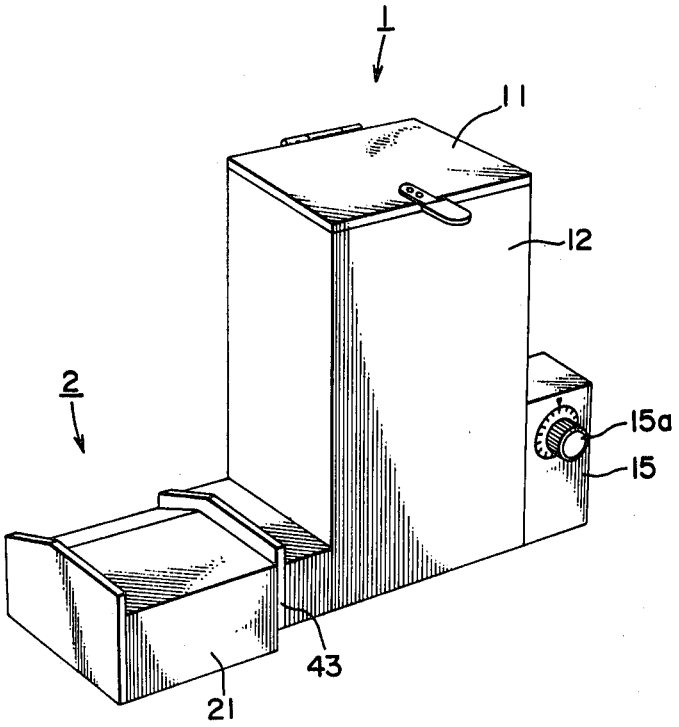
FIG. 1 is a perspective view on the front side of the adhesive coating machine for a hot melt type adhesive.
Figure 2:
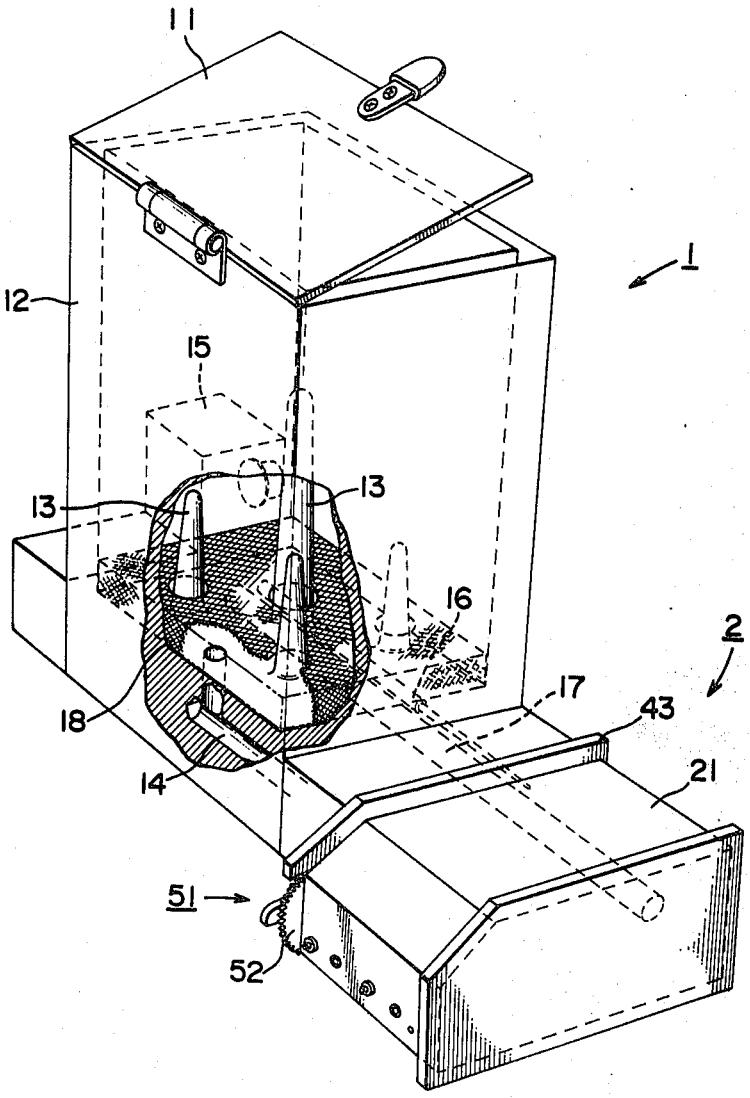
FIG. 2 is a partially cut-away perspective view on the rear side of the apparatus shown in FIG. 1.
Figure 3:
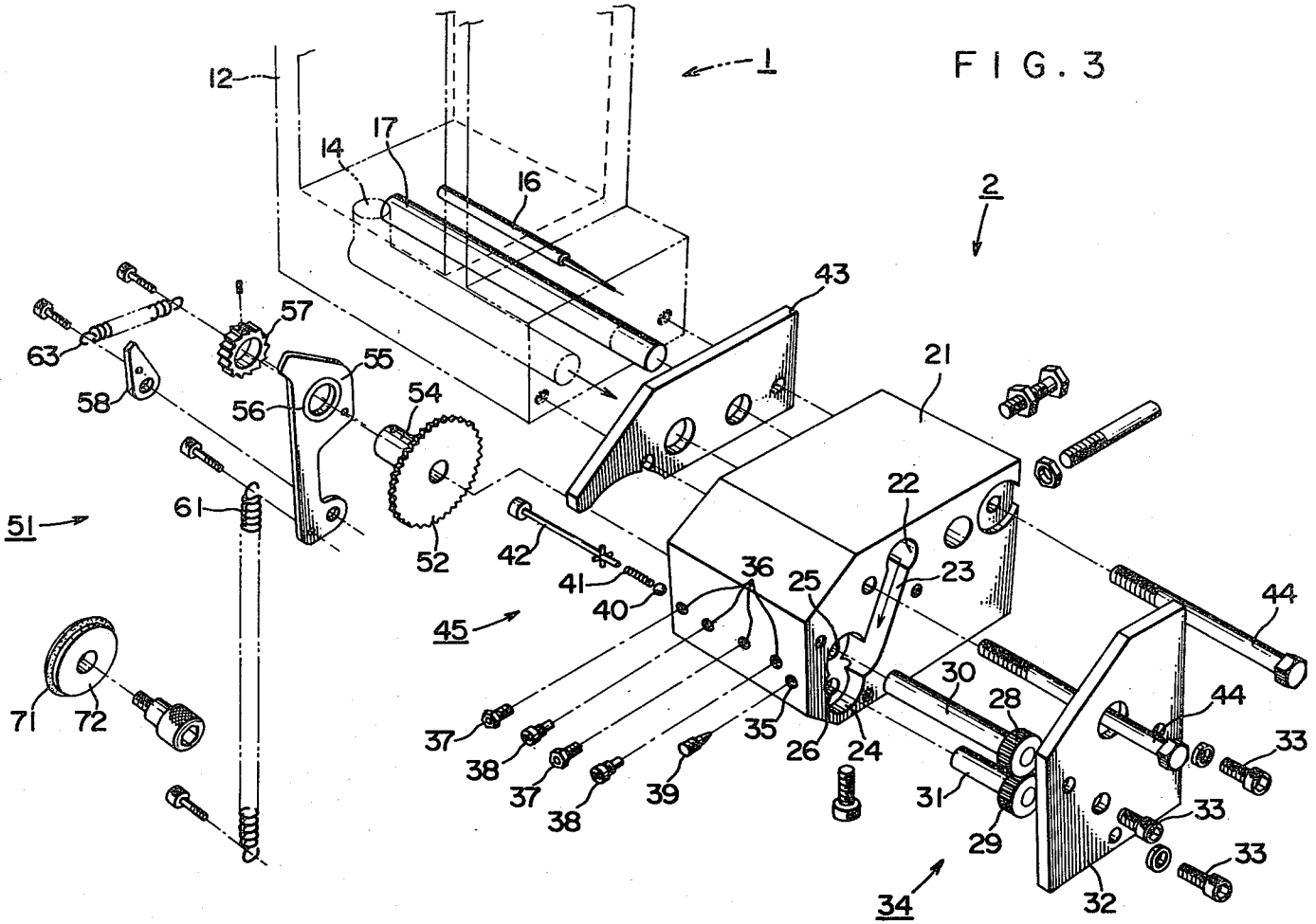
FIG. 3 is its exploded perspective view.

FIGS. 1 through 3 illustrate an adhesive coating machine which is generally referred to as a "hot melt applicator". The machine consists of a tank portion 1 and a head portion 2.

The tank portion 1 is constructed in the following manner. A tank 12 is equipped at its upper part with a lid 11 that can be opened and closed. A plurality of heat conduction protuberances 13 are protrusively formed from the bottom to the upper part of the tank 12 and a passage 14 of the adhesive is bored from the bottom of the tank 12 toward the head portion 2 on its one side. A temperature controller 15 is mounted to the front surface of the other side of the tank 12. A rod-like electric heater 17 which is controlled by the temperature controller 15 and a thermo-sensitive cylinder 16 of the temperature controller 15 are buried to the bottom of the tank 12.

A part of the heater 17 projects toward the head portion 2 and a net-like screen 18 is disposed at the bottom of the tank 12.

On the other hand, the head portion 2 is constructed in the following manner. As shown also in FIG. 4, a passage 22 is defined so as to extend from the other side surface to one side surface of the head block 21 and to communicate with the above-mentioned passage 14 of the tank 12. A groove-like passage 23 and a groove-like gear storing portion 24, that continue one side edge portion of this passage 22, are defined on one side surface of the head block 21. A pair of upper and lower shaft holes 25, 26 and a pressure-feed hole 27 are bored in this gear storing portion 24 so as to extend along the rear surface of the head block 21. The shafts 30, 31 of gears 28, 29 are fitted into the pair of shaft holes 25, 26 and the gears 28, 29 are stored in the gear storing portion 24 while engaging with each other. A cover 32 is fitted to one side surface of the head block by a plurality of screws 33 to close each of the above-mentioned passages 22, 23, gear storing portion 24 and pressure-feed hole 27, thereby forming a gear pump 34. A flow adjusting screw hole 35 communicating with the pressure-feed hole 27 and a plurality of nozzle fitting hole 36 are sequentially bored on the rear surface of the head block 21 and a nozzle 37 and blind screws 38 are fitted to these holes, respectively. A flow adjusting screw 39 having a conical tip is fitted to the screw hole 35. A ball 40 is inserted into the pressure-feed hole 27 from the other side surface of the head block 21 and is brought into contact with the tip of the flow adjusting screw 39 by a coil spring 41, which is inserted into the pressure-feed hole 27 in succession to the ball 40, and by a support rod 42 fitted air-tight to the other side end portion of the pressure-feed hole 27. The position of the ball 40 can be changed by changing the engaging depth of the flow adjusting screw 39 to the screw hole 35, thereby forming a flow adjusting mechanism 45 which adjusts the flow rate of the adhesive which is pressure-fed from the gear pump 34 to each nozzle 37.

The head portion 2 is integrated with the tank portion 1 as the head block 21 is fitted to the bottom on one side surface of the tank 12 by a plurality of screws 44 via a spacer 43.

A driving mechanism 51 for the gear pump 34 is disposed at the rear part on the other side surface of the head block 21. This driving mechanism 51 has the following construction. As shown also in FIGS. 5 and 6, the shaft 30 of the upper gear 28 of the gear pump 34 protrudes from the other side surface of the head block 21 and a drive wheel 52 is fixed to this shaft 30. The saw-toothed circumferential surface of the drive wheel 52 is disposed at the rear of the nozzle 37, that is, inside the passage 53 of an object matter to be coated with the adhesive. A swing arm 55 is loosely fitted to the boss 54 of the drive wheel 52 via a collar 56 and a ratchet wheel 57 is fixed to the boss. A ratchet pawl 58 facing the ratchet wheel 57 is turnably supported by a screw 60 to the swing arm 55 via a collar 59. The swing arm 55 is urged counter-clockwise by a coil spring 61 in FIG. 5 and comes into contact with a first stopper 62 so that the tip 55*a* of the swing arm 55 normally projects into the above-mentioned passage 53 as indicated by solid line in FIG. 5. The ratchet pawl 58 is urged by a coil spring 63 so that the tip of the ratchet pawl 58 normally engages with the ratchet wheel 57. The swing arm 55 rotates clockwise in FIG. 5 against the coil spring 61 and a second stopper 64 is disposed at such a position that when the tip 55*a* of the swing arm 55 moves back from the passage 53 as indicated by double-dot chain line in FIG. 5, it comes into contact with the ratchet pawl 58 and disengages the tip of the ratchet pawl 58 from the ratchet wheel 57.

Both of the above-mentioned drive wheel 52 and ratchet wheel 57 are fixed by a screw 65, and the portion of the collar 56 that is integrally fitted to the swing arm 55 is interposed between the drive wheel 52 and the ratchet wheel 57. The first and second stoppers 62, 64 are implanted to the other side surface of the head block 21.

A back-up roller 72 having a rubber ring 71 fitted around its outer circumference to increase the frictional coefficient is turnably supported at the rear of the passage 53 so as to face the drive wheel 52 and a vertical guide member 73 is disposed on the other side of the passage 53. A plurality of feed rollers 74 are supported in front and at the rear of the upper part of the above-mentioned passage 53 and a plurality of deliver rollers, not shown, are disposed in front and at the rear of the lower part of the passage 53. The feed rollers as well as the deliver rollers are rotated by a motor, not shown, in synchronism with one another.

A pellet-like hot melt adhesive using a thermoplastic resin as the base and having a 100% solid content is stored in the tank 12 and is melted by feeding a current to the heater 17. The dial 15*a* of the temperature controller 15 is set to 180° C., for example, in accordance with the properties of the adhesive so as to control the feed of current to the heater 17.

The molten adhesive passes through the screen 18 and flows into the gear pump 34 through the passages 14, 22, 23. Under this state, a corrugated cardboard sheet 81 as the object matter to be coated is fed into the passage 53 along and from above the guide member 73 by driving the feed rollers 74.

Figure 5:
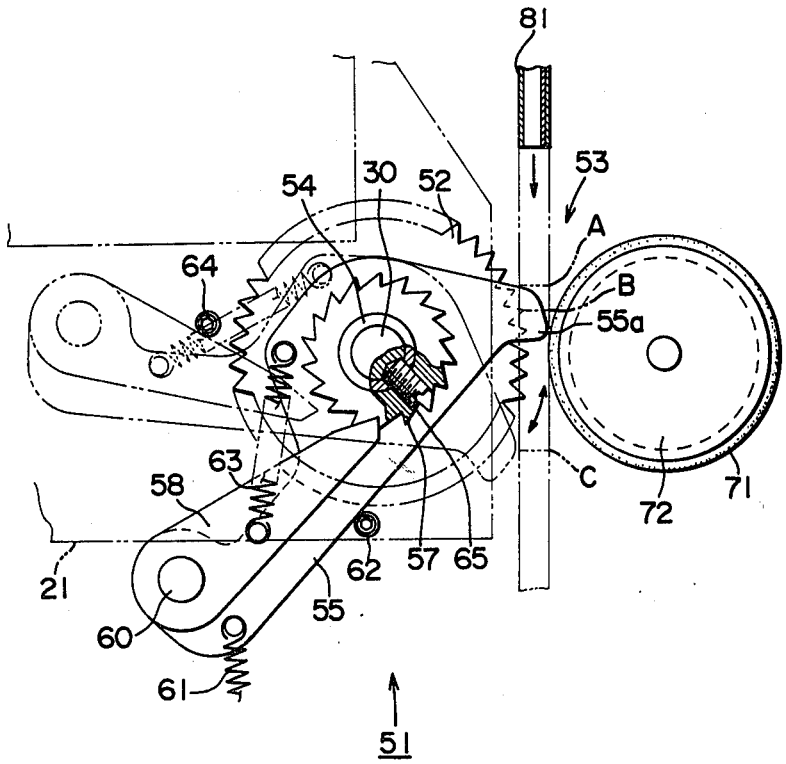
FIG. 5 is a side view showing its driving mechanism.
Figure 6:
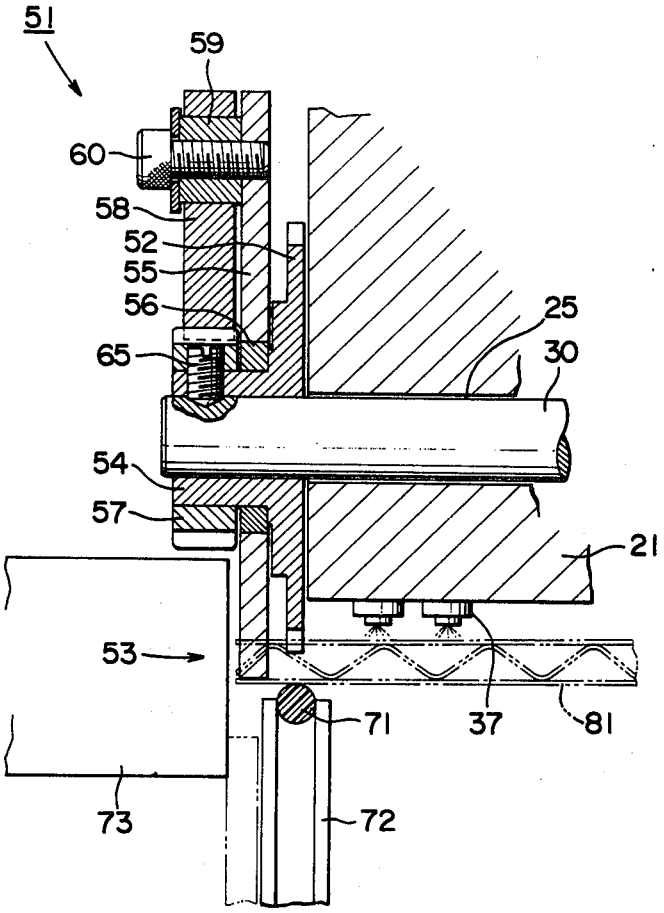
FIG. 6 is a transverse sectional view showing its driving mechanism.

When the tip of the corrugated cardboard sheet 81 moves up to the position (A) in FIG. 5, it comes into contact with the tip 55*a* of the swing arm 55 and when it moves up to the position (B), the tip of the swing arm 55 is pushed and caused to rotate slightly clockwise so that the tip of the ratchet pawl 58 that has engaged with the ratchet wheel 57 disengages therefrom.

Figure 4:
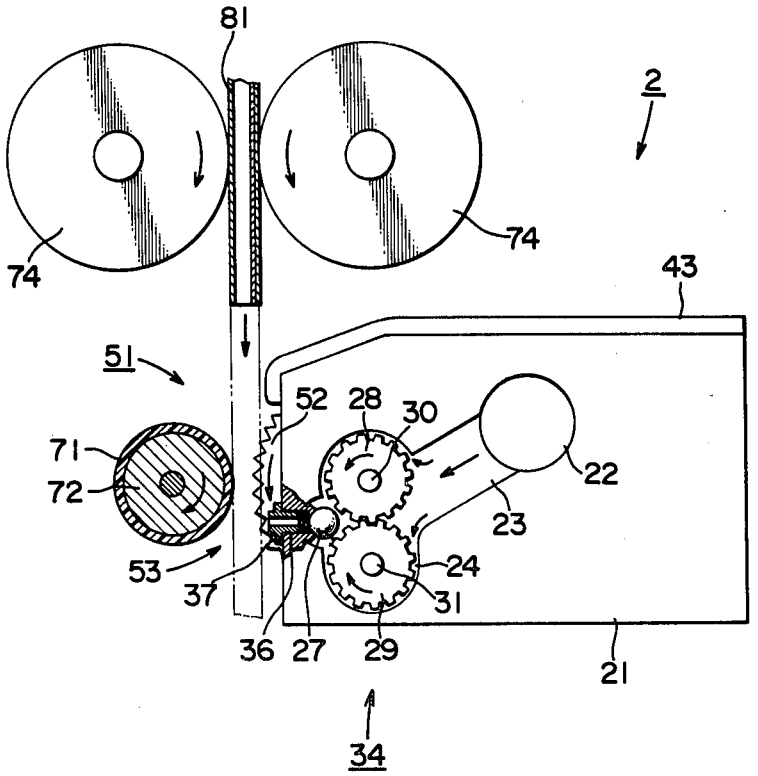
FIG. 4 is a side view showing its gear pump portion.
Figure 7:
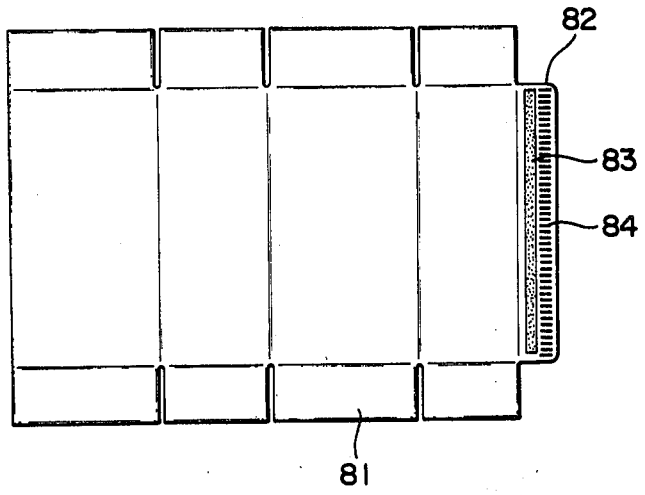
FIG. 7 is a plan view of a corrugated cardboard sheet as the object matter to be coated.

Next, when the tip of the corrguated cardboard sheet 81 moves further downward from the position (B), the saw-toothed circumferential surface of the drive wheel 52 catches the front surface of the corrugated cardboard sheet 81 due to the operation of the back roller 72 so that the drive wheel 52 is rotated clockwise in FIG. 5 and hence, the gears 28, 29 of the gear pump 34 rotate in the direction indicated by an arrow in FIG. 4. The molten hot melt adhesive is then pressure-fed into the nozzle 37 through the pressure-feed hole 27, is ejected from the nozzle 37 to the front surface of the corrugated cardboard sheet 81 that is passing through the passage 53 and forms a bead 83 of the hot melt adhesive at a predetermined position of the corrugated cardboard sheet 81, that is, at the margin 82 for the adhesive. Incidentally, reference numeral 84 in FIG. 7 represents the trace of the saw-toothed circumferential surface of the drive wheel 52 that has caught the corrugated cardboard sheet.

During the period in which the tip of the corrugated cardboard sheet 81 moves from the position (B) to the position (C), the swing arm 55 also rotates clockwise together with the drive wheel 52. At the position (C), the ratchet pawl 58 comes into contact with the second stopper 64 while its tip disengages from the ratchet wheel 57. Thereafter, since the front surface of the corrugated cardboard sheet 81 slides the tip 55*a* of the swing arm 55, both swing arm 55 and ratchet pawl 58 come at halt while maintaining their state and only the drive wheel 52 and the ratchet wheel 57 rotate along with the passage of the corrugated cardboard sheet 81 and the gear pump 34 is driven.

When the rear end part of the corrugated cardboard sheet 81 has moved to the position (C), the drive wheel 52 as well as the tip 55*a* of the swing arm 55 disengage from the corrugated cardboard sheet 81 and the swing arm is rotated counter-clockwise, that is, in the direction opposite the driving rotating direction of the drive wheel 52, by the urging force of the spring 61. At the same time, the ratchet pawl 58 disengages from the second stopper 64 and the tip of the ratchet wheel 58 is caused to engage with the ratchet wheel 57 by the urging force of the spring 63. Hence, the ratchet wheel 57 and the drive wheel 52 rotate counter-clockwise together with the swing arm 55 until the swing arm 55 strikes the first stopper 62. The gear pump 34 rotates reversely and the adhesive at the portion of the nozzle 37 is slightly pulled back so that the adhesive is prevented from flowing out from the nozzle 37 after the passage of the corrugated cardboard sheet 81 or is prevented from cooling and solidifying at the portion of the nozzle 37.

The arrangement of the nozzle 37 and the blind screw 38, the gap between the back-up roller 72 and the drive wheel 52 and the screwing depth of the flow adjusting screw 39 can be suitably set in accordance with various conditions.

In the embodiment described above, the circumferential surface of the drive wheel 52 has a saw-toothed shape since the object matter to be coated is the corrugated cardboard sheet 81. If the object matter to be coated is a relatively hard material such as a veneer or mere thick paper, a wheel analogues to the back-up roller 72 can be used as the drive wheel 52.

In the above-mentioned embodiment, the coil springs 61, 63 are used as means for urging the swing arm 55 and the ratchet pawl 58 but they may be urged by other means such as a weight, for example. The passage 53 of the corrugated cardboard sheet 81 need not be vertical but may extend in other directions such as a horizontal direction, for example.

The above-mentioned embodiment deals with the coating machine of the hot melt type adhesive which can be immediately solidified upon cooling but does not need drying and can be pressbonded within a few seconds unlike emulsion type and solvent type adhesives in general. However, the present invention can also be applied to the coating machine of adhesives of the emulsion and solvent types.

As described in the foregoing, in accordance with the present invention, the gear pump is mechanically driven upon passage of the object matter to be coated and ejects the adhesive. Hence, the power for the pump is not necessary and moreover, detectors for the object matter to be coated, switch valves for controlling the discharge of the adhesive and a control circuit for the detectors and the valves are not necessary, either, reducing remarkably the cost of production of the adhesive coating machine. Additionally, since the gear pump is caused to mechanically and reversely rotate after the passage of the object matter to be coated, the adhesive is prevented from flowing out from the nozzle and contaminating the machine or solidifying at the nozzle portion so that coating of the adhesive can be carried out reliably and stably.

What is claimed is:

1. An adhesive coating machine comprising:

a nozzle disposed so as to face the passage of an object matter to be coated;

a gear pump for pressure-feeding an adhesive into said nozzle;

a drive wheel disposed with the circumferential surface thereof positioned inside said passage and rotated by said object matter to be coated during the passage thereof, thereby driving said gear pump;

a ratchet wheel disposed concentrically and integrally with said drive wheel;

a swing arm fitted loosely and concentrically with said ratchet wheel and with said drive wheel and urged in the direction opposite the driving rotating direction of said drive wheel;

a first stopper disposed so as to face said swing arm and anchoring said swing arm while the tip of said swing arm projects into said passage;

a ratchet pawl turnably supported by said swing arm and urged in such a direction that the tip thereof engages with said ratchet wheel; and a second stopper disposed so as to oppose said ratchet pawl in the arrangement such that it comes into contact with said ratchet pawl and disengages the tip of said ratchet pawl from said ratchet wheel when the tip of said swing arm is pushed by said object matter to be coated and rotates in the same direction as the driving rotating direction of said drive wheel and the tip moves back from said passage during the passage of said object matter to be coated;

said gear pump being driven by the passage of said object matter to be coated via said drive wheel;

said ratchet wheel being rotated by the return rotation of said swing arm after the passage of said object matter to be coated, thereby rotating said drive wheel in a direction opposite the driving rotating direction of said drive wheel and reversely rotating said gear pump.

2. The adhesive coating machine as defined in claim 1, wherein an adhesive tank is connected to said gear pump, is equipped with a heater and a temperature controller for controlling said heater and stores therein said adhesive consisting of a thermoplastic resin.

3. The adhesive coating machine as defined in claim 1 or 2, wherein a flow adjusting mechanism of said adhesive is disposed between said nozzle and said gear pump.

* * * * *